US009135923B1

(12) United States Patent
Chen

(10) Patent No.: US 9,135,923 B1
(45) Date of Patent: Sep. 15, 2015

(54) PITCH SYNCHRONOUS SPEECH CODING BASED ON TIMBRE VECTORS

(71) Applicant: Chengjun Julian Chen, White Plains, NY (US)

(72) Inventor: Chengjun Julian Chen, White Plains, NY (US)

( * ) Notice: Subject to any disclaimer, the term of this patent is extended or adjusted under 35 U.S.C. 154(b) by 0 days.

(21) Appl. No.: 14/605,571

(22) Filed: Jan. 26, 2015

Related U.S. Application Data

(63) Continuation-in-part of application No. 14/216,684, filed on Mar. 17, 2014, now Pat. No. 8,942,977.

(51) Int. Cl.

| | |
|---|---|
| ***G10L 19/02*** | (2013.01) |
| ***G10L 19/125*** | (2013.01) |
| ***G10L 19/038*** | (2013.01) |
| ***G10L 19/035*** | (2013.01) |
| ***G10L 25/90*** | (2013.01) |
| *G10L 19/00* | (2013.01) |

(52) U.S. Cl.
CPC ..... *G10L 19/125* (2013.01); *G10L 19/035* (2013.01); *G10L 19/038* (2013.01); *G10L 25/90* (2013.01); *G10L 2019/0016* (2013.01)

(58) Field of Classification Search
CPC ..... G10L 25/90; G10L 15/02; G10L 13/033; G10L 21/04; G10L 19/12; G10L 2021/065; G10L 21/02; G10L 13/06; G10L 19/0017; G10L 19/08; G10L 19/093; G10L 21/003
USPC ..... 704/203–210, 213–215, 221–230
See application file for complete search history.

(56) References Cited

U.S. PATENT DOCUMENTS

H0002172 H * 9/2006 Staelin et al. ..... 704/207
2002/0173951 A1* 11/2002 Ehara ..... 704/219

OTHER PUBLICATIONS

Hess, Wolfgang. "A pitch-synchronous digital feature extraction system for phonemic recognition of speech." Acoustics, Speech and Signal Processing, IEEE Transactions on 24.1 (1976): 14-25.*
Mandyam, Giridhar, Nasir Ahmed, and Neeraj Magotra. "Application of the discrete Laguerre transform to speech coding." Asilomar Conference on Signals, Systems and Computers. IEEE Computer Society, 1995.*

* cited by examiner

*Primary Examiner* — Huyen Vo

(57) ABSTRACT

A pitch-synchronous method and system for speech coding using timbre vectors is disclosed. On the encoder side, speech signal is segmented into pitch-synchronous frames without overlap, then converted into a pitch-synchronous amplitude spectrum using FFT. Using Laguerre functions, the amplitude spectrum is transformed into a timbre vector. Using vector quantization, each timbre vector is converted to a timbre index based on a timbre codebook. The intensity and pitch are also converted into indices respectively using scalar quantization. Those indices are transmitted as encoded speech. On the decoder side, by looking up the same codebooks, pitch, intensity and the timbre vector are recovered. Using Laguerre functions, the amplitude spectrum is recovered. Using Kramers-Kronig relations, the phase spectrum is recovered. Using FFT, the elementary waves are regenerated, and superposed to become the speech signal.

20 Claims, 6 Drawing Sheets

```
IMAC:codred julianchen$ od -b a0008.dat
0000000   033 307 000 072 320 002 331 337 002 105 363 002 246 363 002 357
0000020   364 003 112 374 003 264 372 003 162 376 303 162 377 003 050 376
0000040   304 050 375 004 167 375 003 166 375 303 166 376 303 166 370 302
0000060   166 372 301 166 356 301 166 347 001 364 337 001 251 341 001 200
0000100   326 001 261 314 001 104 312 001 101 307 001 207 305 000 210 305
0000120   002 136 305 102 136 114 101 100 041 136 130 132 056 132 056 301
0000140   000 301 313 003 110 327 001 316 327 001 002 333 001 241 336 001
0000160   206 344 001 060 345 001 203 344 301 203 340 001 020 340 001 222
0000200   331 001 177 325 001 176 323 001 256 323 301 256 331 001 177 347
0000220   001 203 351 001 011 352 001 065 366 001 050 366 301 050 372 002
0000240   065 367 002 200 367 302 200 322 001 004 311 001 053 314 002 141
0000260   323 002 232 364 002 273 365 302 273 365 003 147 363 003 013 355
0000300   003 344 346 003 241 337 003 103 326 002 323 312 002 313 312 202
0000320   313 007 310 000 301 310 000 301 145 135 137 053 120 006 120 006
0000340   301 000 152 327 003 033 347 003 111 360 002 376 361 002 216 360
0000360   002 125 353 002 132 355 002 125 355 302 125 353 002 371 352 002
0000400   255 345 002 144 340 002 367 344 002 010 345 002 230 347 002 366
0000420   347 302 366 354 302 366 352 002 040 324 001 035 310 001 042 310
0000440   001 042 000 134 130 134 023 155 066 175 017 175 017 311 000 301
0000460   314 003 063 343 002 002 367 002 303 365 002 272 374 002 200 366
0000500   002 065 371 002 174 371 002 065 372 002 174 367 002 264 346 002
0000520   227 337 002 232 331 002 311 317 002 163 310 002 156 310 202 156
0000540   150 010 170 012 174 147 171 156 167 067 146 165 146 165 005 211
0000560   002 024 215 176 024 316 002 063 331 002 051 341 002 002 346 002
0000600   344 343 002 020 342 001 043 336 001 260 337 001 373 337 301 373
0000620   342 001 223 343 002 035 334 001 042 330 002 313 322 002 136 313
0000640   002 163 301 000 107 301 300 107 306 005 313 306 005 313 132 024
0000660   135 021 154 010 161 124 146 062 123 041 134 174 125 041 125 141
0000700   301 000 336 304 003 327 317 003 165 336 003 224 345 003 120 351
0000720   002 327 360 002 374 361 302 374 351 301 374 343 301 374 336 301
0000740   374 324 001 226 324 301 226 320 001 327 320 001 236 316 000 170
0000760   312 000 232 312 000 201 311 300 201 310 000 005 315 002 357 303
0001000   003 217 320 003 223 304 004 323 314 002 223 302 003 323 305 000
0001020   042 307 001 107 304 002 163 304 002 163 106 101 106 101 034
```

FIG. 6

PITCH SYNCHRONOUS SPEECH CODING BASED ON TIMBRE VECTORS

The present application is a continuation in part of U.S. Pat. No. 8,942,977, entitled "System and Method for Speech Recognition Using Pitch-Synchronous Spectral Parameters", issued Jan. 27, 2015, to inventor Chengjun Julian Chen.

FIELD OF THE INVENTION

The present invention generally relates to speech coding, in particular to pitch-synchronous speech coding using timbre vectors.

BACKGROUND OF THE INVENTION

Speech coding is an important field of speech technology. The original speech signal is analog. The transmission of original speech signal takes a huge bandwidth and it is error prone. For several decades, coding methods and systems have been developed, to compress the speech signal to a low-bit-rate digital signal for transmission. The current status of the technology is summarized in a number of monographs, for example, Part C of "Springer Handbook of Speech Processing", Springer Verlag 2007; and "Digital Speech", Second Edition, by A. M. Kondoz, Wiley, 2004. There are several hundreds of patents and patent applications with "speech coding" in the title. The system of speech coding has two components. The encoder converts speech signal to a compressed digital signal. The decoder converts the compressed digital signal back into analog speech signal. The current technology for low bit rate speech coding is based on the following principles:

For encoding, first, speech signal is segmented into frames with a fixed duration. Second, a program determines whether a frame is voiced or unvoiced. Third, for voiced frames, find the pitch period in the frame. Fourth, extract the linear predictive code (LPC) of each frame. The voicedness index (voice or unvoiced), the pitch period, and LPC coefficients are then quantized to a limited number of bits, to become the encoded speech signal for transmission. In the decoding process, the voiced segments and the unvoiced segments are treated differently. For voiced segments, a string of pulses are generated according to the pitch period, and then filtered by the LPC based spectrum to generate the voiced sound. For unvoiced segments, a noise signal is generated, and then filtered by the LPC based spectrum to generate an unvoiced consonant. Because pitch period is a property of the frame, each frame must be longer than the maximum pitch period of human voice, which is typically 25 msec. The frame must be multiplied with a window function, typically a Hamming window function, to make the ends approximately matching. To ensure that no information is neglected, each frame must overlap with the previous frame and the following frame, with a typical frame shift of 10 msec.

The quality of LPC-based speech coding is limited by the intrinsic properties of the LPC coefficients, which is pitch-asynchronous, and has a rather small number of parameters because of non-converging behavior when the number of coefficients is increased. The usual limit is 10 to 16 coefficients. The quality of the LPC-based speech coding is always compared with the 8-kHz sample rate 8 bit voice signal, the so-called legacy telephone standard, toll quality speech signal, or narrow-band speech signal. Coming to the 21th century, all voice recording device and voice production device can provide CD-quality speech signal, with at least 32 kHz sample rate and 16 bit resolution. Toll-quality speech signal is considered poor. Speech coding should be able to generate quality comparable to the CD-quality speech signal.

It is well known that the voiced speech signal is pseudo-periodic, and the LPC coefficients become inaccurate at the onset time of a pitch period. To improve the quality of speech coding, pitch-synchronous speech coding has been proposed, researched and patented. See for example, R. Taori et al, "Speech Compression Using Pitch Synchronous Interpolation", Proceedings of ICASSP-1995, vol. 1, pages 512-515; H. Yang et al., "Pitch Synchronous Multi-Band (PSMB) Speech Coding", Proceedings of ICASSP-1995, vol. 1, page 516-519; C. Sturt et al., "LSF Quantization for Pitch Synchronous Speech Coders", Proceedings of ICASSP-2003, vol. 2, pages 165-168; and U.S. Pat. No. 5,864,797 by M. Fujimoto, "Pitch-synchronous Speech Coding by Applying Multiple Analysis to Select and Align a Plurality of Types of Code Vectors", Jan. 26, 1999. They showed that by using pitch-synchronous LPC coefficients or using pitch-synchronous multi-band coding, the quality can be improved.

In the two previous patents by the current applicant (U.S. Pat. No. 8,719,030 entitled "System and Method for Speech Synthesis", U.S. Pat. No. 8,942,977 entitled "System and Method for Speech Recognition Using Pitch-Synchronous Spectral Parameters"), a pitch-synchronous segmentation scheme and a new mathematical representation, timbre vectors, are proposed, as an alternative to the fixed-window-size segmentation and LPC coefficients. The new methods enable the parameterization and reproduction of wide-band speech signal with high fidelity, thus provide a new method of speech coding, especially for CD-quality speech signals. The current patent application discloses systems and methods of speech coding using timbre vectors.

SUMMARY OF THE INVENTION

The present invention discloses a pitch-synchronous method and system for speech coding using timbre vectors, following U.S. Pat. No. 8,719,030 and U.S. Pat. No. 8,942,977.

According to an exemplary embodiment of the invention, see FIG. 1, a speech signal is first going through a pitch-marks picking program to pick the pitch marks. The pitch marks are extended to unvoiced sections to generate a complete set of segmentation points. The speech signal is segmented into pitch-synchronous frames according to the said segmentation points. An ends-meeting program is executed to make the values at the two ends of every frame equal. Using FFT (fast Fourier transform), the speech signal in each frame is converted into a pitch-synchronous amplitude spectrum, then use Laguerre functions to convert the said pitch-synchronous amplitude spectrum into a unit vector characteristic to the instantaneous timbre, referred to as the timbre vector. Using scalar quantization, the pitch period and the intensity are converted into a pitch index and an intensity index using a pitch codebook and an intensity codebook. Using vector quantization, each timbre vector is converted to a timbre index using a timbre codebook. Together with the type index (silence, unvoiced consonants, voiced consonants, and vowel), those indices are transmitted as encoded speech.

On the decoding side, as shown in FIG. 2, the type index is first fetched. According to the type, indices for pitch, intensity, and timbre are then fetched, and corresponding codebooks are chosen. Then a look-up program picks up the pitch, intensity and timbre vector for the said pitch period. The rest of the process follows U.S. Pat. No. 8,719,030, to generate voice signal from the type, pitch, intensity and timbre of the said frame (pitch period).

Because the period by period process duplicates the natural process of speech production, and the timbre vectors catches detailed information about the spectrum of the speech segment, the decoded voice can have a much higher quality than the speech coding algorithm based on fixed-duration frames and linear prediction coding (LPC) parameterization, and can still be transmitted with very low bandwidth.

BRIEF DESCRIPTION OF DRAWINGS

FIG. 6 shows the octal values of a sample of encoded speech.

DETAILED DESCRIPTION OF THE INVENTION

Various exemplary embodiments of the present invention are implemented on a computer system including one or more processors and one or more memory units. In this regard, according to exemplary embodiments, steps of the various methods described herein are performed on one or more computer processors according to instructions encoded on a computer-readable medium.

Figure 1:
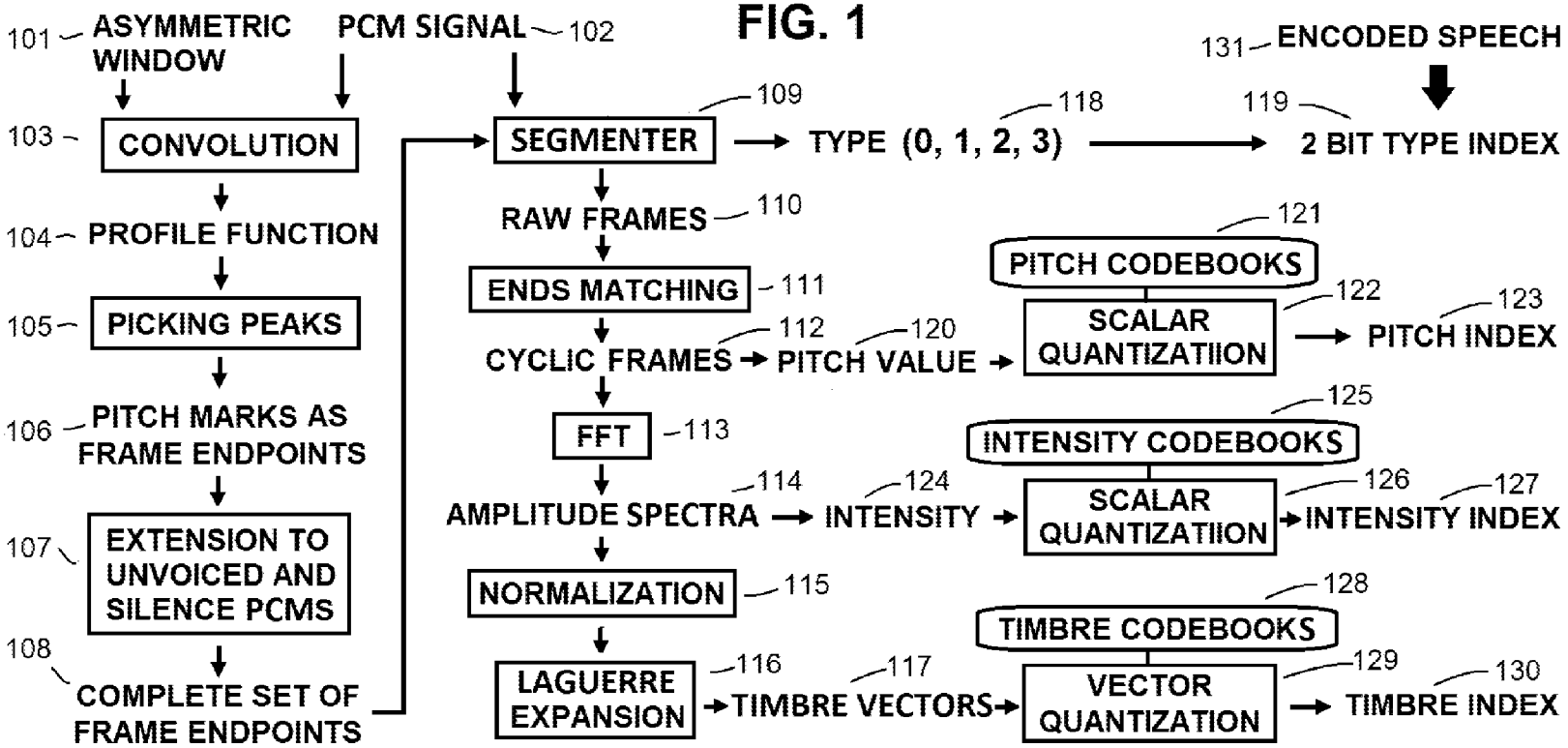
FIG. 1 is a block diagram of an encoding system using pitch-synchronous speech parameterization through timbre vectors.

FIG. 1 is a block diagram of speech encoding system according to an exemplary embodiment of the present invention. The input signal 102, typically in PCM (pulse-code modulation) format, is first convoluted with an asymmetric window 101, to generate a profile function 104. The peaks 105 in the profile function, with values greater than a threshold, are assigned as pitch marks 106 of the speech signal, which are the frame endpoints in the voice section of the input speech signal 102. The pitch marks only exist for the voiced sections of the speech signal. Using a procedure 107, those frame endpoints are extended into unvoiced and silence sections of the PCM signal, typically by dividing those sections with a constant time interval, in the exemplary embodiment it is 8 msec. A complete set of frame endpoints 108 is generated. Through a segmenter 109, using the said frame endpoints, the PCM signal 102 is then segmented into raw frames 110. In general, the PCM values of the two ends of a raw frame do not match. By performing Fourier analysis on those raw frames, artifacts would be generated. An ends-matching procedure 111 is applied on each raw frame to convert it into a cyclic frame 112 which can be legitimately treated as a sample of a continuous periodic function. Then, a fast Fourier transform (FFT) unit 113 is applied to each said frame 112 to generate an amplitude spectrum 114. The intensity of the spectrum is calculated as the intensity value 124, and then normalized by unit 115. The normalized amplitude spectrum is then expanded using Laguerre functions 116, to generate a set of expansion coefficients, referred to as a timbre vector 117, similar to the timbre vectors in U.S. Pat. No. 8,719,030 and U.S. Pat. No. 8,942,977.

During the above process, the type of the said frame (pitch period) is determined, see 118. If the amplitude is smaller than a silence threshold, the frame is silence, type 0. If the intensity is higher than the silence threshold but there is no pitch marks, the frame is unvoiced, type 1. For frames bounded by pitch marks, if the amplitude spectrum is concentrated in the low-frequency range (0 to 5 kHz), than the period is voiced, type 3. If the amplitude spectrum in the higher-frequency range (5 to 16 kHz) is substantial, for example, has 30% or more power, then the period is transitional which is voices fricative or a transition frame between voiced and unvoiced, type 2. The type information is encoded in a 2-bit type index, 119. For voiced periods, the pitch value, 120, is conveniently expressed in MIDI unit. Using a pitch codebook 121, the said pitch is scalar-quantized by unit 122. The said intensity 124 is conveniently expressed in decibel (dB) unit. Using an intensity codebook 125, through scalar quantization 126, the intensity index 127 of the frame is generated. Furthermore, using a timbre codebook 128, using vector quantization 129, the timbre index 130 of the frame is generated. Notice that for each type of frame, there is a different codebook. Details will be disclosed later with respect to FIG. 5. Comparing with LPC, the timbre vector is a better subject for vector quantization, because the distance measure (or distortion measure) of the timbre vectors is very simple. According to U.S. Pat. No. 8,719,030 and U.S. Pat. No. 8,942,977, it is $$\delta = \sum_{n=0}^{N} [c_n^{(1)} - c_n^{(2)}]^2.$$

Figure 2:
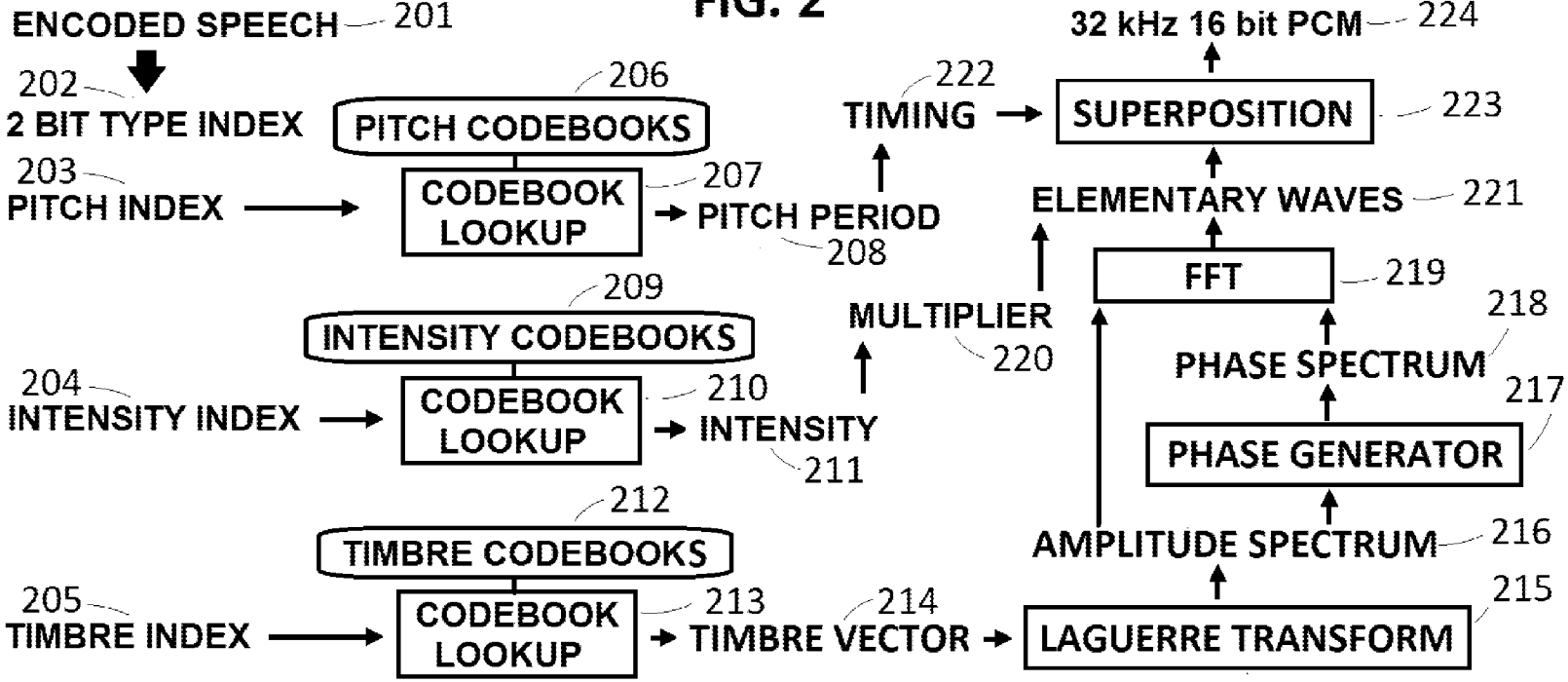
FIG. 2 is a block diagram of a decoding system using pitch-synchronous speech parameterization through timbre vectors.

FIG. 2 shows the decoding process. From the signals transmitted to the decoder, the 2-bit type index is first fetched. If the frame is silence, a silence PCM, 8 msec of zeros, is sent to the output. If the frame is voiced, type 3, or transitional, type 2, the pitch index 203, the intensity index 204, and the timbre index 205, are fetched. Using the pitch codebook for voiced frames or the pitch codebook for transitional frames, 206, through a look-up procedure 207, the pitch period 208 is identified. Using the intensity codebook for voiced frames or the intensity codebook for transitional frames, 209, through a look-up procedure 210, the intensity of the frame 211 is identified. The intensity 211 and the timbre vector 214 are sent to the waveform recovery unit, 215 through 221, to generate the elementary wave for that frame. The procedure is described in detail in U.S. Pat. No. 8,719,030, especially page 3, lines 42-50. Briefly, using Laguerre transform 215, the timbre vector 214 is converted back to amplitude spectrum 216. Using a phase generator 217 based on Kramers-Kronig relations, the phase spectrum 218 is generated from the amplitude spectrum 216. Using fast Fourier transform (FFT) 219, an elementary waveform 221 is generated. Those elementary waves are lineally superposed using superposition unit 223 according to the time delay 222 defined by the pitch period 208, to generate PCM output 224. For unvoiced frames, type 1, the procedure is identical, except the pitch period, or the frame duration, is a fixed value, which is 8 msec in the current exemplary embodiment. And the phase is random over the entire frequency scale.

Figure 3:
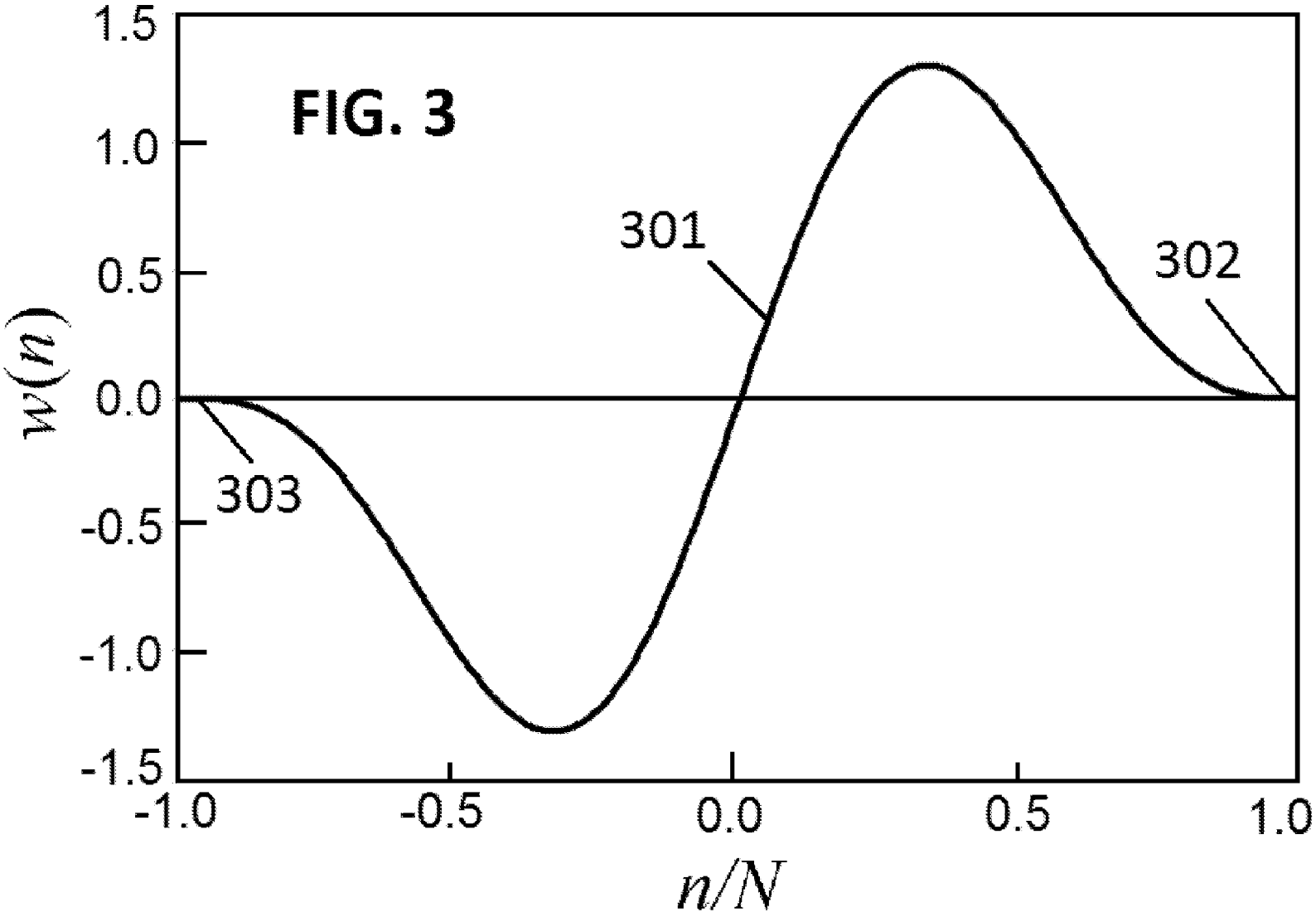
FIG. 3 is an example of the asymmetric window for finding pitch marks.

FIG. 3 shows an example of the asymmetric window function (item 101 of FIG. 1) for pitch mark identification. On an interval (−N<n<N), the formula is $$w(n) = \pm\sin\left(\frac{\pi n}{N}\right)\left[1 + \cos\left(\frac{\pi n}{N}\right)\right].$$

The ± sign is used to accommodate the polarity of the PCM signals. If a positive sign is taken, the value is positive for 0<n<N, but becomes zero at n=N; and it is negative for −N<n<0, again becomes zero at n=−N. Denoting the PCM signal as p(n), A profile function is generated $$f(m) = \sum_{n=-N}^{n<N} w(n)[p(m+n) - p(m+n-1)].$$

Figure 4:
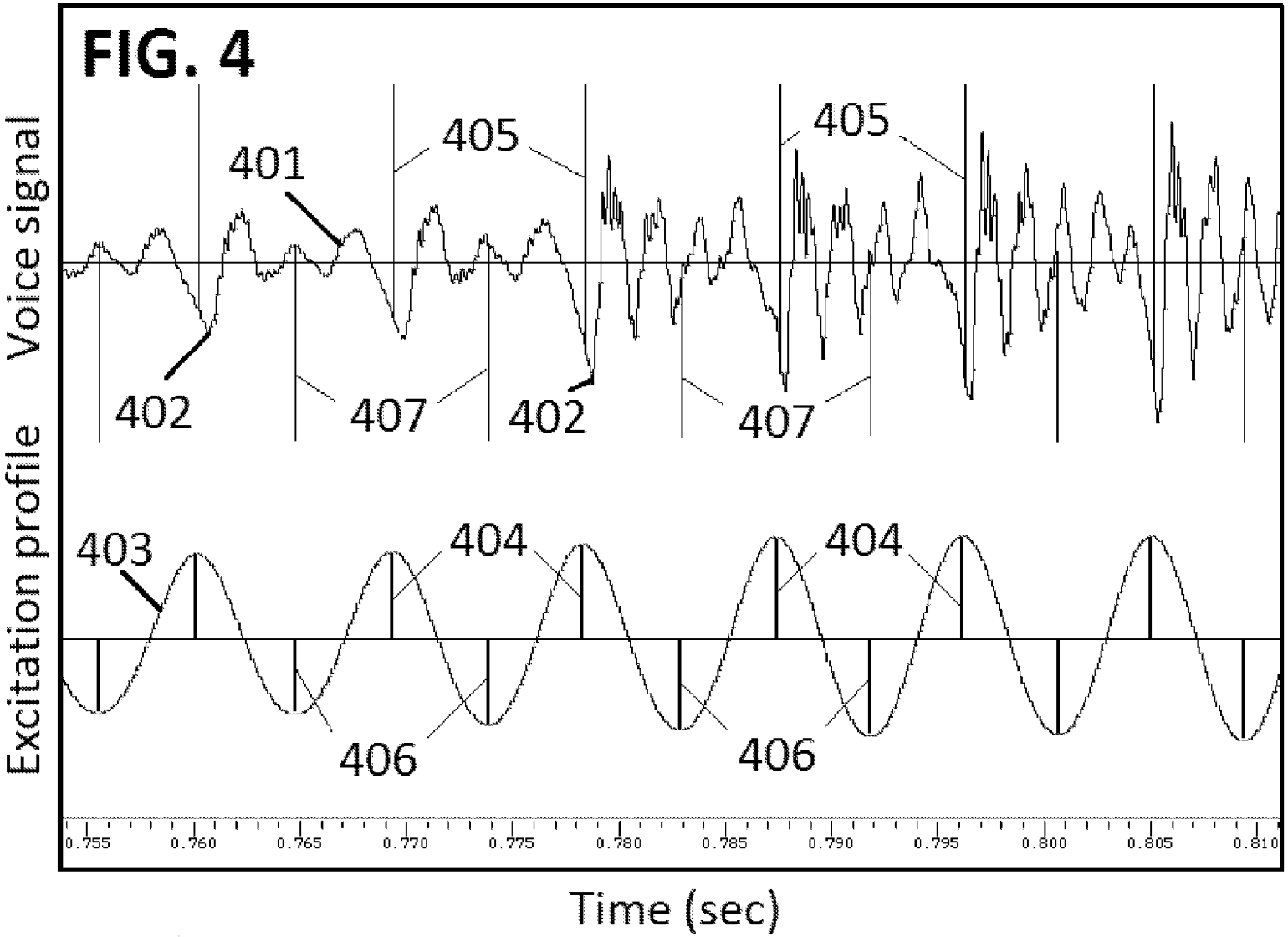
FIG. 4 is an example of the profile function for finding the pitch marks.

Typical result is shown in FIG. 4. Here, 401 is the voice signal. Item 402 indicates the starting point of each pitch period, where the variation of signal is the greatest. 403 is the profile function generated using the asymmetric window function w(n). As shown, the peak positions 404 of the profile function 403 are pointing to the locations with weak variation 405. Its mechanism is also shown in FIG. 4: Each pitch period starts with a large variation of PCM signal at 402. The variation decreases gradually and becomes weak near the end of each pitch period. However, it depends on the relative polarity of the signal and the asymmetric window. If the polarity of the asymmetric window if reversed, then the peak 406 points to the middle of a pitch period, 407. The polarity of the speech signal depends on the microphone and the amplifier circuit, and it should be identified before the encoding process.

Figure 5:
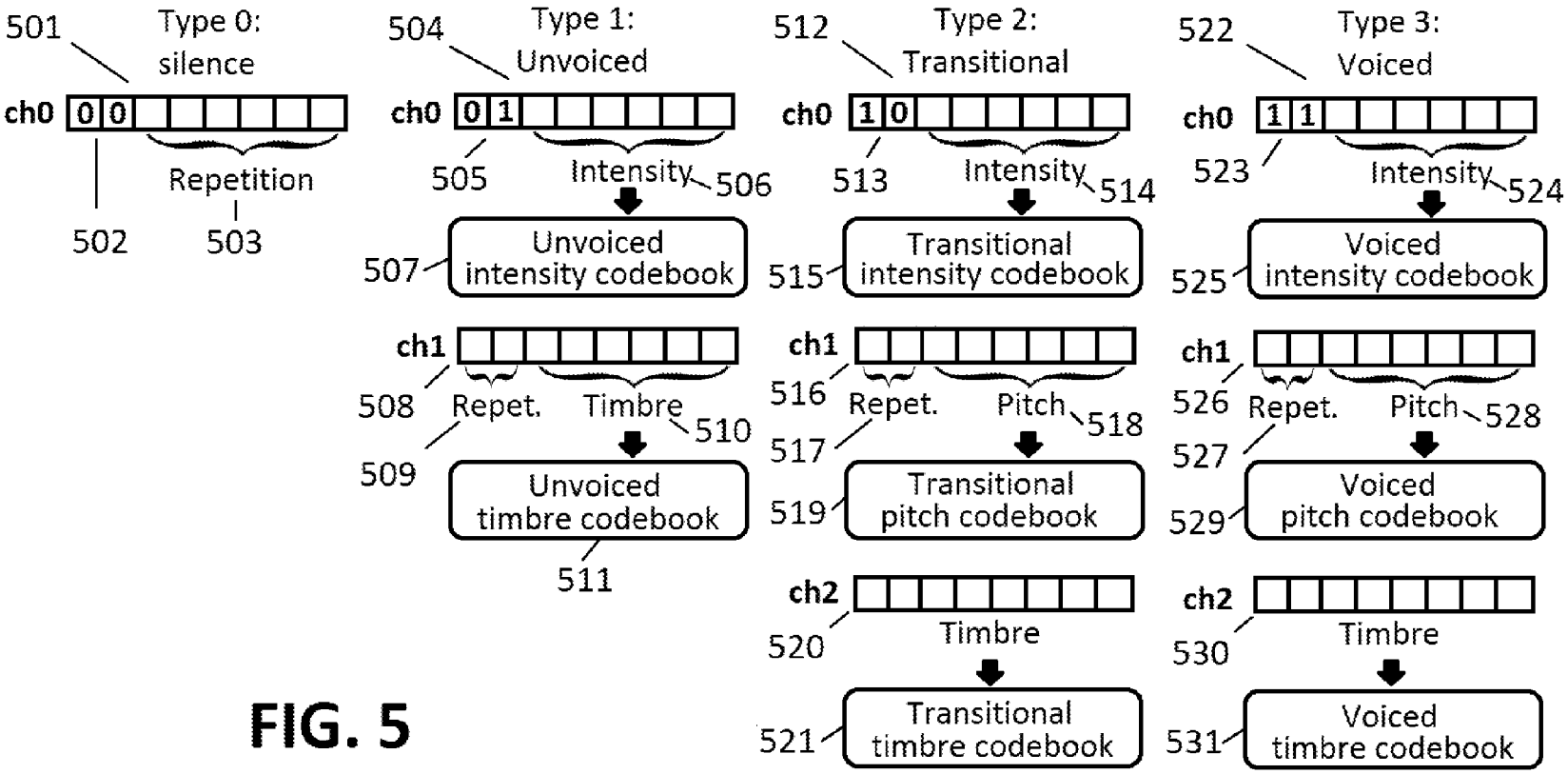
FIG. 5 shows an example of the spectrograms of the original speech and the decoded speech.

FIG. 5 shows a particular design of the bit allocation for the indices. The design is a proof-of-the-concept coding scheme, not optimized for quality and minimizing the bandwidth. In the said design, only integer number of bytes is used. Therefore, it can be viewed by displaying the octal values of each byte. In the said design, the number of frame repetition is encoded, represented by a repetition index, see below.

As shown in FIG. 5, the decoder first fetches a byte 501. The highest two bits indicate the type of the frame. If the highest bits are 00, see 502, the frame is silence. The rest 6 bits 503 represent the repetition index, from 0 to 63. In a proof-of-concept prototype, each silence frame is 8 msec. The maximum silence tine which can be represented by a single byte is 512 msec, or one half of a second. Such a designation will not cause coding delay. When the speaker is silent, the encoder is waiting for the end of the silence, than output a silence byte. On the decoder side, no signal is transmitted, the output is naturally silence, and until the silence byte arrives.

If the first byte of a group of bytes has highest bits of 01, see 504 and 505, the frame is unvoiced. The frame duration is also 8 msec. Pitch index is not required. The rest 6 bits are the intensity index, 506. By looking up from an unvoiced intensity codebook 507, the intensity of the said unvoiced frame is determined. Each unvoiced frame is represented by two bytes. The first two bits of the second byte represent number of repetition. If two consecutive frames have the identical timbre vector, the repetition index is 1. If three consecutive frames have the identical timbre vector, the repetition index is 2. The maximum repetition is set to 3. This upper bound is designed for two purposes. First, the intensity of the repeated frames has to be interpolated from the end-point frames. To ensure quality, a limit of four frames is needed. Second, the encoding of four repeated unvoiced frames takes 32 msec. Because the tolerable encoding delay is 70 to 80 msec, as 32 msec is acceptable, too many frames would cause too much encoding delay.

If the first two bits of the leading byte 512 or 513 are 10 or 11, see 513 and 523, the frame is voiced or transitional, and two following bytes should be fetched from the transmission stream, ch1 and ch2. Similar to the case of unvoiced frames, the rest 6 bits of the leading byte represent intensity index, 514 or 524. By looking up from an intensity codebook, 515 or 525, the intensity is determined. The second byte, 516 or 526, carries a repetition index, 516 or 526, and a pitch index, 518 or 528. The repetition index is limited to 4, and both intensity and pitch have to be linearly interpolated from the two ending-point frames. By looking up from a pitch codebook, 519 or 529, the pitch value is determined. The third byte 520 or 530 is timbre index. By looking up from a timbre codebook, 521 or 531, the timbre vector is determined. Because the type of frame is separated, a codebook size of 256 for each type seems adequate.

During encoding, the determination of type 2 (transitional) and type 3 (voiced) is based on the spectral distribution, as presented above: If the speech power in a frame with a well-defined pitch period is concentrated in the low-frequency range (o to 5 kHz), the frame is voiced. If the power in the high frequency range (5 kHz and up) is substantial, then it is a transitional frame. During encoding, different types of frames are treated differently. For voiced frames, below 5 kHz, the phase is generated by the Kramers-Knonig relations; and above 5 kHz, the phase is random. For transitional frames, below 2.5 kHz, the phase is generated by the Kramers-Knonig relations; and above 2.5 kHz, the phase is random. For unvoiced frames, the phase is random on the entire frequency scale. For details, see U.S. Pat. No. 8,719,030.

To improve naturalness, jitter may be added to the pitch values. To do this, a few percentages (usually 1% to 3%) of random number is added to the pitch value. Furthermore, shimmer may also be added to the intensity value. To do this, a few percentages (usually 1% to 3%) of random number is added to the intensity value.

Fast Fourier transform (FFT) is an efficient method for Fourier analysis. However, FFT is much more efficient if the period is an integer power of 2, such as 64, 128, 256, etc. For voiced frames, the pitch period is a variable. In order to utilize FFT, the PCM values in each pitch period is first linearly interpolated into $2^n$ points, in the exemplary embodiment presented here, it is 8×32=256 points. After FFT, the amplitude spectrum is reversely interpolated to the true values of the pitch period.

The art of building of codebooks is well known in the literature, see for example, A. Gersho and R. M. Gray, "Vector Quantization and Signal Compression", Kluwer Academic Publishers, Boston, 1991. The basic method of building codebooks is the K-means clustering algorithm. A brief summary of the said algorithm can be found in F. Jelinek, "Statistical Methods for Speech Recognition", The MIT Press, Cambridge Mass., 1997, page 10-11. Briefly, the K-means clustering process for timbre vectors is as follows: A large database of timbre vectors of a category (voiced, unvoiced or transitional) is collected; choose randomly a fixed number of timbre vectors as seeds; divide the entire vector space to find clusters of timbre vectors closest to each seed; find the center of each cluster. Use the cluster centers as the new seeds, repeat the said process until the centers of clusters converge. The number of seeds, and consequently the number of cluster centers, is called the size of the codebook.

An example of the encoded speech is shown in FIG. 6, encoded from sentence a0008, spoken by a U.S. English speaker bdl, in ARCTIC databases, published by CMU Language Technologies Institute, 2003. The duration of the speech is 2.5 seconds. The encoded speech has 543 bytes, or 4344 bits. Therefore, the bit rate is 4.344/2.5=1.737 kb/s, in the very-low-bit-rate range. Nevertheless, nearly CD-quality voice is regenerated. The advantages of the current method are predicable from its principle. First, the maximum bandwidth according to the current invention can be 16 kHz or greater using a PCM speech signal of 32 kHz sampling rate or higher and 16 bit resolution. The legacy speech coding is based on 4 kHz bandwidth (8 kHz PCM sampling rate, 8 bit), the fricatives such as [f] and [s] are not distinguishable. Using the algorithm disclosed in the current invention, the fricatives [f] and [s] are clearly distinguishable. Furthermore, while the legacy low-bit-rate speech coding is based on an all-pole model of speech signal which fails to represent the nasal sounds, the technology disclosed in the current invention reproduces the entire spectrum, and the nasal sounds are reproduced faithfully.

While this invention has been described in conjunction with the exemplary embodiments outlined above, it is evident that many alternatives, modifications and variations will be apparent to those skilled in the art. Accordingly, the exemplary embodiments of the invention, as set forth above, are intended to be illustrative, not limiting. Various changes may be made without departing from the spirit and scope of the invention.

I claim:

1. A method of speech communication from a transmitter to a receiver using a plurality of processors comprising an encoder to compress the speech signal into a digital form and a decoder to recover speech signal from the said compressed digital form comprising:

(A) an encoder in the transmitter comprising the following elements:

segment the voice-signal into non-overlapping frames, wherein for voiced sections the frames are pitch periods and for unvoiced sections the frame duration is a constant;

identify the type of a said frame to generate a type index;

identify the pitch period of a said frame from the segmentation process;

generate amplitude spectra of a said frame using Fourier analysis;

generate an intensity parameter of a said frame from the amplitude spectrum;

transform the said amplitude spectrum into timbre vectors using Laguerre functions;

apply vector quantization to the said timbre vector using a timbre-vector codebook to generate a timbre index;

apply scalar quantization to said intensity parameter using an intensity codebook to generate an intensity index;

apply scalar quantization to said pitch period with a pitch codebook to generate a pitch index;

transmit the type index, intensity index, pitch index and timbre index to the receiver;

(B) a decoder in the receiver comprising the following elements:

take the transmitted intensity index, look-up into the intensity codebook to identify the intensity;

take the transmitted pitch index, look-up into the pitch codebook to identify the pitch;

take the transmitted timbre index, look-up into the timbre-vector codebook to identify the timber vector;

inverse transform the said timbre vector into amplitude spectra using Laguerre functions;

generate phase spectrum from the amplitude spectrum using Kramers-Knonig relations;

use fast Fourier transform to generate an elementary waveform from the said amplitude spectrum, phase spectrum, and intensity;

superpose the said elementary waves according to the timing provided by the pitch period to generate an output speech signal.

2. The method of claim 1, wherein the speech signal is segmenting by steps comprising:

convolute the speech signal with an asymmetric window to generate a profile function;

take the peaks of the said profile function that is greater than a threshold as the segmentation points in the voiced section of the said speech signal;

extend the segmentation points to unvoiced sections where no peaks in the said profile function above a threshold with a fixed time interval.

3. The method of claim 1, wherein the pitch period is defined as the time difference of two consecutive peaks above a threshold value in the said profile function.

4. The method of claim 1, wherein the types of a frame is defined as:

type 0, silence, when the intensity is smaller than a silence threshold;

type 1, unvoiced, when there is no pitch marks detected;

type 2, transitional, when a pitch mark is found and the speech power in the upper frequency range is greater than a percentage, as an example, greater than 30% above 5 kHz;

type 3, voiced, when a pitch mark is found and the speech power in the upper frequency range is smaller than a percentage, as an example, smaller than 30% above 5 kHz.

5. The method of claim 1, wherein the timbre vector codebooks are constructed using the K-means clustering algorithm comprising:

collect a large number of timbre vectors of a given type (voiced, unvoiced, or transitional) from a database of speech;

according to the desired size N of codebook, randomly select N timber vectors as seeds;

for each seed, find the timber vectors closest to the said seed to form a cluster;

find the center of the said cluster;

use the said cluster centers as the new seeds, repeat the process until the values converge.

6. The method of claim 1, wherein the intensity codebooks and the pitch codebooks are constructed using scalar quantization from large databases.

7. The method of claim 1, wherein the bit rate of encoded speech is further reduced by using a repetition index to represent repeated indices.

8. The method of claim 1, wherein the naturalness of output speech is improved by adding shimmer to the intensity values.

9. The method of claim 1, wherein the naturalness of output speech is improved by adding jitter to the pitch values.

10. The method of claim 1, wherein the said Fourier analysis in the encoding stage is executed using a scaled fast Fourier transform (FFT) comprising:

interpolate the PCM values in a pitch period into an integer power of 2, for example 256;

perform FFT on the said interpolated signals to generate an amplitude spectrum;

linearly interpolate the said amplitude spectrum to the correct frequency scale.

11. An apparatus of speech communication from a transmitter to a receiver using a plurality of processors comprising an encoder to compress the speech signal into a digital form and a decoder to recover speech signal from the said compressed digital form comprising:

(A) an encoder in the transmitter comprising the following elements:

segment the voice-signal into non-overlapping frames, wherein for voiced sections the frames are pitch periods and for unvoiced sections the frame duration is a constant;

identify the type of a said frame to generate a type index;

identify the pitch period of a said frame from the segmentation process;

generate amplitude spectra of a said frame using Fourier analysis;

generate an intensity parameter of a said frame from the amplitude spectrum;

transform the said amplitude spectrum into timbre vectors using Laguerre functions;

apply vector quantization to the said timbre vector using a timbre-vector codebook to generate a timbre index;

apply scalar quantization to said intensity parameter using an intensity codebook to generate an intensity index;

apply scalar quantization to said pitch period with a pitch codebook to generate a pitch index;

transmit the type index, intensity index, pitch index and timbre index to the receiver;

(B) a decoder in the receiver comprising the following elements:

take the transmitted intensity index, look-up into the intensity codebook to identify the intensity;

take the transmitted pitch index, look-up into the pitch codebook to identify the pitch;

take the transmitted timbre index, look-up into the timbre-vector codebook to identify the timber vector;

inverse transform the said timbre vector into amplitude spectra using Laguerre functions;

generate phase spectrum from the amplitude spectrum using Kramers-Knonig relations;

use fast Fourier transform to generate an elementary waveform from the said amplitude spectrum, phase spectrum, and intensity;

superpose the said elementary waves according to the timing provided by the pitch period to generate an output speech signal.

12. The apparatus of claim 11, wherein the speech signal is segmenting by steps comprising:

convolute the speech signal with an asymmetric window to generate a profile function;

take the peaks of the said profile function that is greater than a threshold as the segmentation points in the voiced section of the said speech signal;

extend the segmentation points to unvoiced sections where no peaks in the said profile function above a threshold with a fixed time interval.

13. The apparatus of claim 11, wherein the pitch period is defined as the time difference of two consecutive peaks above a threshold value in the said profile function.

14. The apparatus of claim 11, wherein the types of a frame is defined as:

type 0, silence, when the intensity is smaller than a silence threshold;

type 1, unvoiced, when there is no pitch marks detected;

type 2, transitional, when a pitch mark is found and the speech power in the upper frequency range is greater than a percentage, as an example, greater than 30% above 5 kHz;

type 3, voiced, when a pitch mark is found and the speech power in the upper frequency range is smaller than a percentage, as an example, smaller than 30% above 5 kHz.

15. The apparatus of claim 11, wherein the timbre vector codebooks are constructed using the K-means clustering algorithm comprising:

collect a large number of timbre vectors of a given type (voiced, unvoiced, or transitional) from a database of speech;

according to the desired size N of codebook, randomly select N timber vectors as seeds;

for each seed, find the timber vectors closest to the said seed to form a cluster;

find the center of the said cluster;

use the said cluster centers as the new seeds, repeat the process until the values converge.

16. The apparatus of claim 11, wherein the intensity codebooks and the pitch codebooks are constructed using scalar quantization from large databases.

17. The apparatus of claim 11, wherein the bit rate of encoded speech is further reduced by using a repetition index to represent repeated indices.

18. The apparatus of claim 11, wherein the naturalness of output speech is improved by adding shimmer to the intensity values.

19. The apparatus of claim 11, wherein the naturalness of output speech is improved by adding jitter to the pitch values.

20. The apparatus of claim 11, wherein the said Fourier analysis in the encoding stage is executed using a scaled fast Fourier transform (FFT) comprising:

interpolate the PCM values in a pitch period into an integer power of 2, for example 256;

perform FFT on the said interpolated signals to generate an amplitude spectrum;

linearly interpolate the said amplitude spectrum to the correct frequency scale.

* * * * *